US006742759B2

(12) United States Patent
Vappula

(10) Patent No.: US 6,742,759 B2
(45) Date of Patent: Jun. 1, 2004

(54) MAGNET UNIT FOR CONCRETE MOULDS

(75) Inventor: Kari Vappula, Toijala (FI)

(73) Assignee: Addtek Research & Development Oy AB, Vantaa (FI)

( * ) Notice: Subject to any disclaimer, the term of this patent is extended or adjusted under 35 U.S.C. 154(b) by 71 days.

(21) Appl. No.: 10/067,837

(22) Filed: Feb. 8, 2002

(65) Prior Publication Data

US 2002/0112430 A1 Aug. 22, 2002

(30) Foreign Application Priority Data

Feb. 16, 2001 (FI) ..... 010076 U

(51) Int. Cl.[7] ..... B28B 7/00

(52) U.S. Cl. ..... 249/139; 249/163; 249/187.1; 425/DIG. 33

(58) Field of Search ..... 249/139, 160, 249/163, 187.1; 425/3, DIG. 33; 52/396.04, 396.08, 402

(56) References Cited

U.S. PATENT DOCUMENTS 3,530,540 A * 9/1970 Meuller ..... 425/3
6,082,701 A * 7/2000 Reymann ..... 249/160
6,434,894 B2 * 8/2002 Reymann ..... 52/127.7

FOREIGN PATENT DOCUMENTS

| | | | |
|---|---|---|---|
| EP | 0 639 686 A2 * | 2/1995 | |
| EP | 0 945 238 A2 * | 9/1999 | |
| EP | 1 075 917 A2 * | 2/2001 | |
| WO | WO 96/14972 | 5/1996 | |

* cited by examiner

*Primary Examiner*—James P. Mackey
*Assistant Examiner*—Donald Heckenberg
(74) *Attorney, Agent, or Firm*—Burns, Doane, Swecker & Mathis, L.L.P.

(57) ABSTRACT

The invention relates to a mould side system for concrete casts. The magnet unit according to the invention has no movable parts, but the magnet is a fixed component of the unit and detachment is carried out using a simple level tool. The fastening of the mould side to the magnet unit takes place by a known slanted-notch principle. According to an advantageous embodiment, the magnet unit has two faces for fastening mould sides, whereby parallel sides of separate, adjacent moulds may be fixed using the same magnet.

6 Claims, 3 Drawing Sheets

MAGNET UNIT FOR CONCRETE MOULDS

TECHNICAL FIELD

This invention relates to a mould side system for concrete casts, which system comprises side sections, which can be detachably fastened to a casting bed using one or several magnets. In particular, the invention relates to an uncomplicated magnet unit.

TECHNICAL BACKGROUND

Detachable sides for concrete element casting moulds, provided with various fastening designs, are known in the art. The sides can be assembled on the casting bed in desired locations depending on the size and shape of the object to be cast.

When concrete wall elements are cast, a bed mould or turning mould with sides is normally used. The casting machine moves above the bed and dispenses concrete mass into the mould. When the cast is hardened, the bed is tilted around an axis along one edge into an almost upright position, the upper mould side is removed and the element is lifted away from the bed using links in its side. The position of the upper mould must be adjustable according to the size of the cast element, and for this purpose detachable sides may be used. With the help of detachable mould side units, which may be freely positioned, openings can also be formed in desired parts of the element.

The use of magnets for fastening detachable mould side units is known, and magnets are well suited for side fastening as they adhere to the flat steel surface of the casting bed. In order to achieve a firm bond, strong magnets providing a bonding force of e.g. 15 kN must be used. In EP 1 075 917, a magnet unit is disclosed which attaches itself to a counterpiece in the mould side by means of a slanted protrusion or jaw on its front face, said protrusion biting into a corresponding slanted notch in the counterpiece. The front face of the magnet unit is designed to provide a precise 90° angle in respect to the casting bed when the magnet unit is fastened to the mould side, whereby the front face attaches itself firmly to the rear surface of the mould side and holds it upright, due to the wedging notch action characteristic to the fastening system. In the magnet unit according to EP 1 075 917, a tilting magnet is provided which can be either in a lower position attached to the casting bed, or in an upper, standby position. To detach the magnet from the casting bed and tilt it to the standby position, a dual action lever is used.

DISCLOSURE OF THE INVENTION

The invention provides a straightforward and veratile system particularly for fastening mould sides for low (5–120 mm) facade slabs. The magnet unit according to the invention has no movable parts, but the magnet is a fixed component of the unit and detaching is carried out using a simple lever tool. The fastening of the mould side to the magnet unit takes place using the jaw principle known from EP 1 075 917.

Due to the uncomplicated design of the magnet unit, several faces for fastening mould sides can be provided on the unit. When double sided magnet units according to claim 3 are used, several parallel moulds can be assembled on a small area, whereby adjacent mould sides are supported by common magnet units.

Together with the magnet unit according to the invention, a smooth-face jaw mould side is used, preferably having a continuous counter-wedge surface for the magnet unit. The relevant profile can be produced by the meter and cut into individual lengths. The profile may constitute a mould side either as such or, for example, be provided with a plywood surface. It may be constructed in one piece of from separate parts. Due to the guiding counter-wedge in the mould side, various slots in the cast are easily produced using reinforcement sections.

The internal forces of the system make the interface of the mould side and the magnet unit completely rigid. When in position, the magnet body acts as a spring element as the magnet is pulled towards the bed. The mould side strives to seal, by its front edge, the joint between the mould side and the casting bed, and resists any tendency of the side falling backwards.

Assembly is quick and easy, and the fastening position may be selected at will, steplessly. By this method of fastening, the positioning of the mould in exactly the right position is enabled, as well as detachment of the magnet unit without displacing the mould side.

An important property of the magnet unit according to the invention is, that it can be positioned at the joints of the mould side units, whereby it both connects the side units together and attaches them to the casting bed. Corner joints can also be made using appropriate fastening adaptors.

In a system according to the invention, ready-made mould side and magnet units can be kept in stock, which units can be readily combined to form the required furnishings. Present-day requirements relating to ergonomics and automation have also been taken into account (low weight, smooth surfaces, ease of cleaning, robot handling). The mould side is best manufactured from special strength steel. Also, extruded aluminium, light metal, plastics or the like can be used. The shape of the mould side enables robot handling in moving and storage of mould side units.

BRIEF DESCRIPTION OF THE DRAWINGS

The invention and its particulars are more closely described in the following with reference to the attached drawings, of which FIG. 1 shows a cross section of a magnet unit 1 according to the invention, a mould side 2 and a cast object 3 on a casting bed 4. The magnet unit 1 comprises a body 5, with a magnet 6 permanently fixed thereto. The jaw profile 7 of body 5 bites into the counter wedge profile of mould side 2 as the magnet force pulls the unit towards casting bed 4. Simultaneously, the front face 8 precisely aligns the mould side. In the embodiment of FIG. 1, the mould side has, on the side facing the concrete cast, a shape providing a slanted side on the finished slab. For easy manipulation, one or several handles 9 can be provided on the magnet unit. For detachment, a slot 16 is provided in the bottom edge of the short side of the magnet unit, which side has no wedge profile and thus remains free for this purpose when the magnet is in use.

FIG. 2 shows a double-sided version of the magnet unit according to the invention. This magnet unit 10 has two wedge faces 11, 12 on opposite sides, which faces attach themselves to parallel mould side units 13, 14 belonging to separate moulds. In this case, the mould side units are flat on the side of the cast. In this manner, several castings can be produced on a small area of the casting bed.

FIG. 3*a* is a side view of the magnet unit 1 of FIG. 1 and mould side 2 attached to casting bed 4. Detachment is carried out using tool 15 in slot 16 to lever one end of the magnet unit off the casting bed. After the initial detachment, the unit can be lifted away by hand as shown in FIG. 3*b*.

Figure 1:
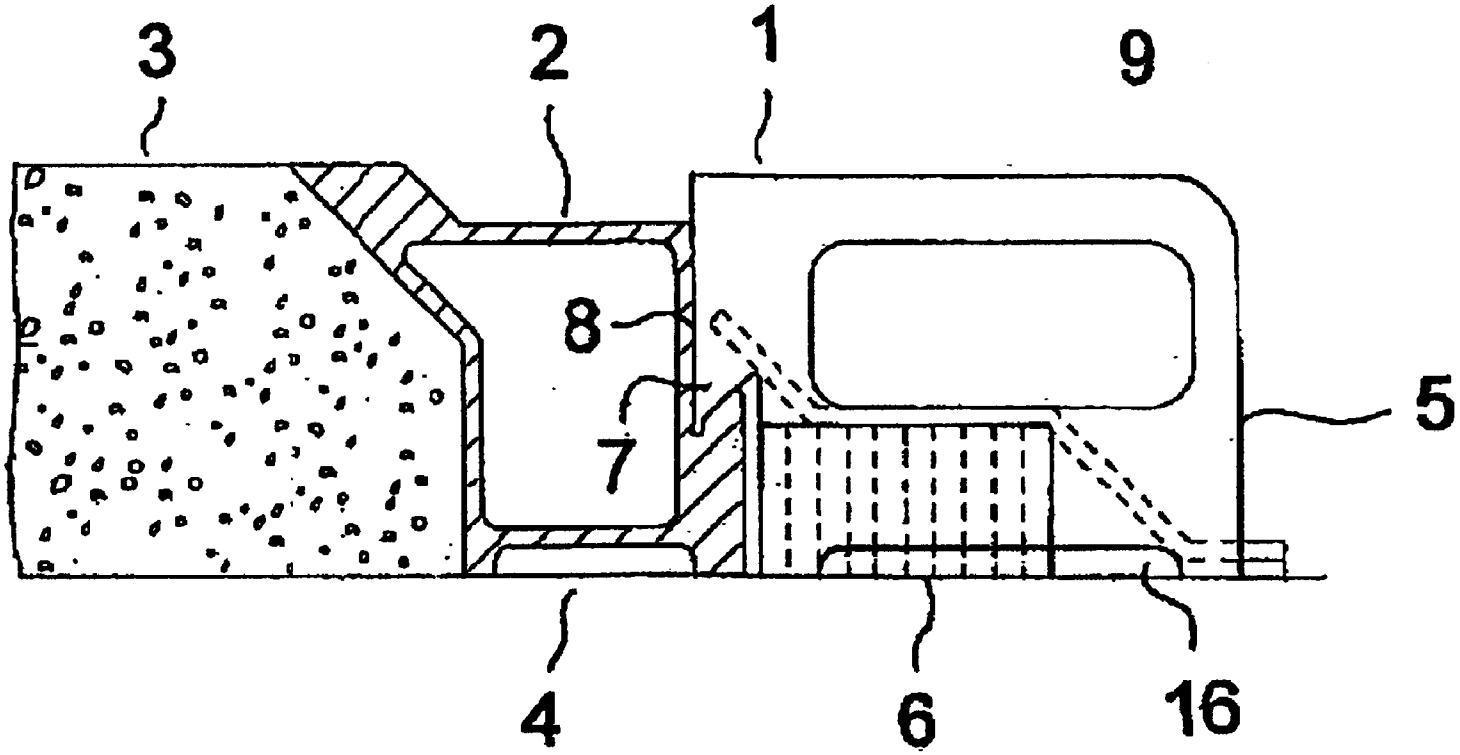
FIG. 1 is a cross section of a single front face magnet unit according to the invention attached to a mould side.
Figure 2:
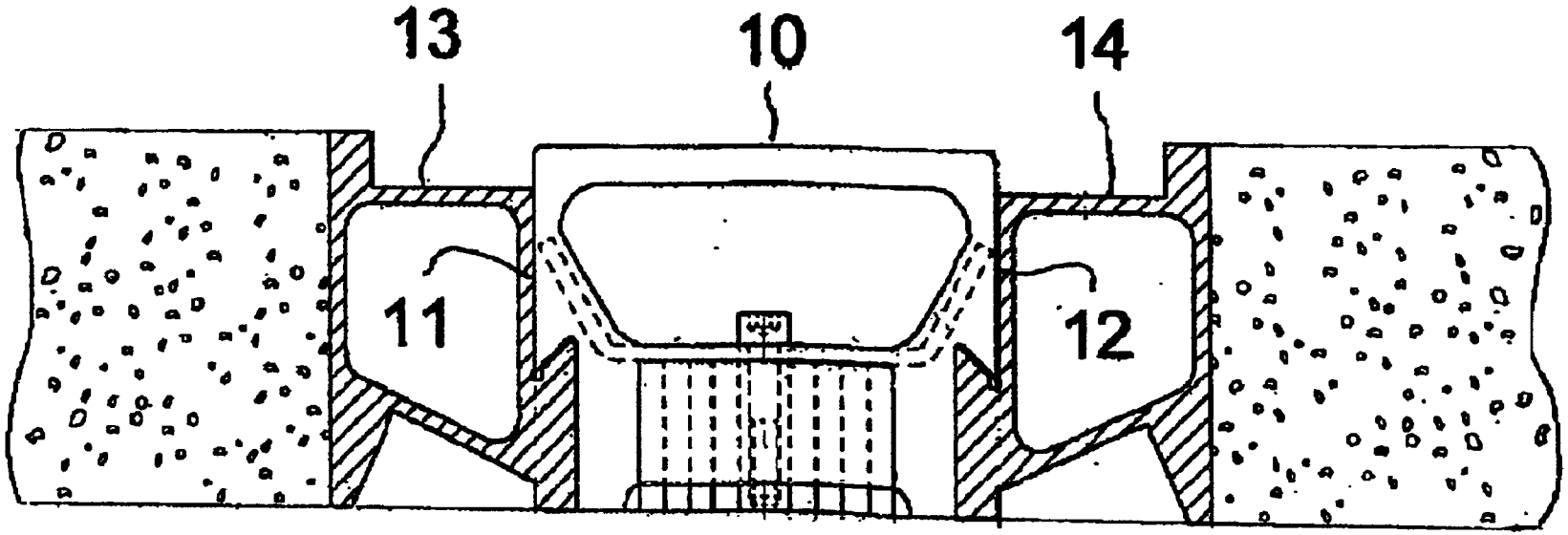
FIG. 2 is a corresponding cross section of a double front face magnet unit according to the invention attached to two parallel mould sides.
Figure 3:
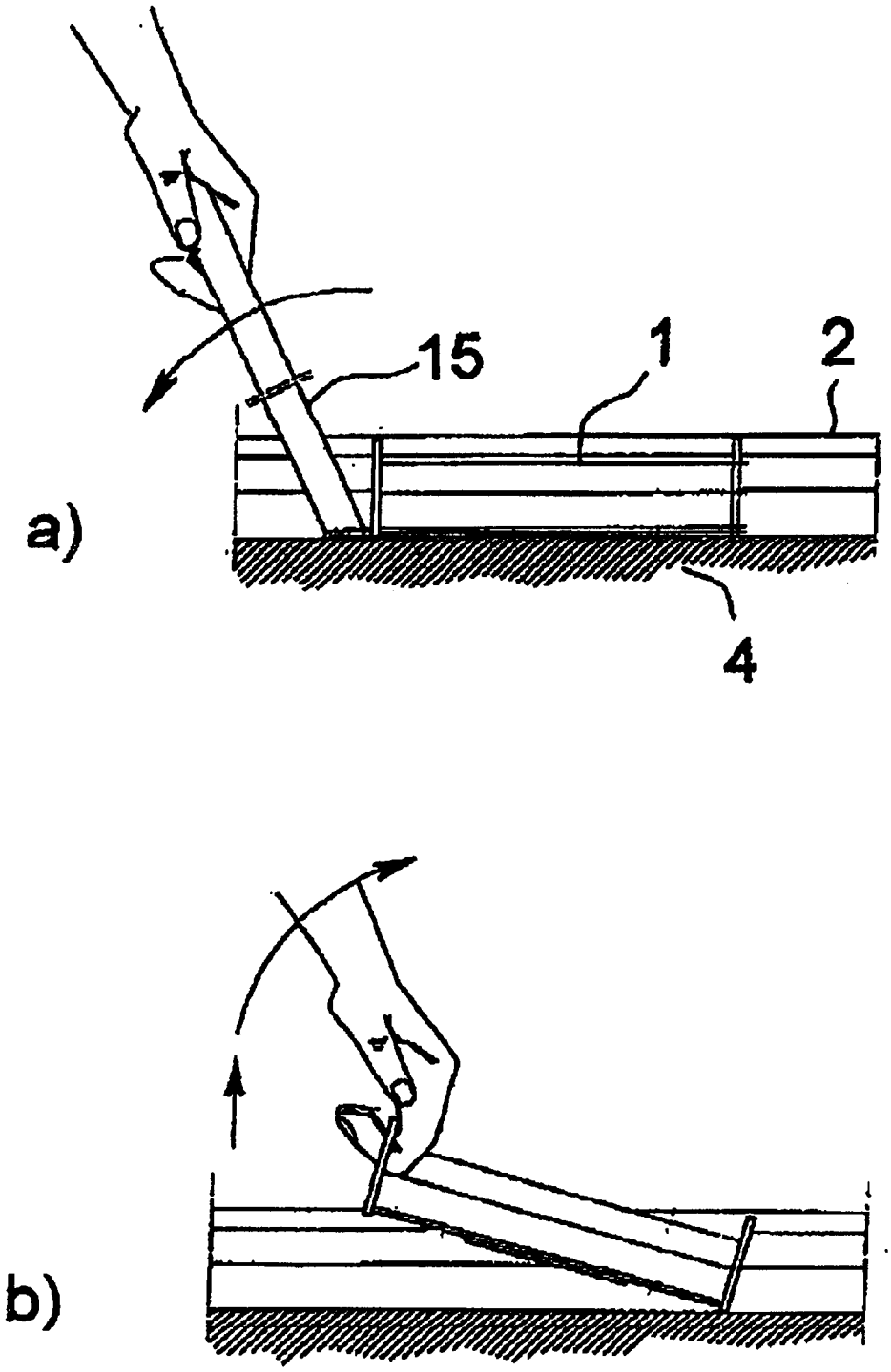
FIGS. 3*a* and 3*b* show the detachment from the casting bed of a magnet unit according to the invention.

What is claimed is:

1. Magnet arrangement for fastening a concrete mould side to a casting bed, comprising:

a magnet unit having a body having at least one front face and a downwardly facing wedge recess for receiving an upwardly facing wedge on a mould side, and a magnet fixed in the body for attaching the unit to a metallic casting bed; and a detaching tool for tilting the body relative to the casting bed about an axis substantially perpendicular to the front face.

2. Magnet arrangement according to claim 1, comprising two faces provided with wedge profiles for fitting to counter wedge surfaces on two mould side units.

3. Magnet arrangement according to claim 2, wherein the faces are on opposite sides of the magnet unit.

4. Magnet arrangement according to claim 1, comprising a slot for receiving at least a portion of the detaching tool in at least one surface not having a wedge recess.

5. Magnet arrangement according to claim 2, comprising a slot for receiving at least a portion of the detaching tool in at least one surface not having a wedge recess.

6. Magnet arrangement according to claim 3, comprising a slot for receiving at least a portion of the detaching tool in at least one surface not having a wedge recess.

* * * * *